United States Patent [19]

Lanning et al.

[11] 4,394,913

[45] Jul. 26, 1983

[54] CRANE HAVING POWER OPERATED OUTRIGGERS AND LOCK MEANS THEREFOR

[75] Inventors: John M. Lanning, Solon; Stephan R. Epps, Cedar Rapids, both of Iowa

[73] Assignee: Harnischfeger Corporation, West Milwaukee, Wis.

[21] Appl. No.: 203,944

[22] Filed: Nov. 7, 1980

[51] Int. Cl.[3] ..... B66C 23/78

[52] U.S. Cl. ..... 212/189; 280/764.1; 280/765.1

[58] Field of Search ..... 212/189, 247, 229; 280/764, 765, 766, 181

[56] References Cited

U.S. PATENT DOCUMENTS

| | | | |
|---|---|---|---|
| 2,047,604 | 7/1936 | Weichardt | 212/247 |
| 2,706,120 | 4/1955 | Stratton | 212/189 |
| 2,914,194 | 11/1959 | Brown | 212/189 |
| 3,263,837 | 8/1966 | Holler et al. | 212/229 |
| 3,266,647 | 8/1966 | Ziskal et al. | 212/229 |
| 3,278,046 | 10/1966 | Shumaker | 212/247 |
| 3,638,805 | 2/1972 | Garnier | 212/189 |
| 3,854,595 | 12/1974 | Kuhn | 212/189 |
| 4,082,197 | 4/1978 | Stedman | 212/189 |
| 4,128,180 | 12/1978 | Mellious | 280/764 |
| 4,175,902 | 11/1979 | Herzog | 280/764 |

FOREIGN PATENT DOCUMENTS

| | | | |
|---|---|---|---|
| 2431955 | 3/1974 | Fed. Rep. of Germany | 212/189 |

*Primary Examiner*—Trygve M. Blix
*Assistant Examiner*—C. T. Bartz
*Attorney, Agent, or Firm*—James E. Nilles

[57] ABSTRACT

A crane of the type having a boom and which requires transversely swingable outriggers to stabilize the crane when the boom is in operation. Power operated means are provided between the main frame of the crane and the outriggers for swinging the outriggers to any one of a number of positions. Power operated locking means are also provided between the main frame of the crane and the outriggers for locking the latter in their selected position.

3 Claims, 10 Drawing Figures

CRANE HAVING POWER OPERATED OUTRIGGERS AND LOCK MEANS THEREFOR

BACKGROUND OF THE INVENTION

Various types of power operated outriggers have been proposed for cranes including those which telescope directly outward from the side of the main frame but this type of extensible outrigger is somewhat limited as to the length it can be extended due to space limitations. Other types of outriggers are pivoted at one end to the main frame and swung about a generally vertical axis to an outer transverse position for stabilization. The latter type of outriggers may be operated manually or with power, but generally have certain components which are in the way and obstruct the movement of the personnel around the crane or obstruct movement of the load being moved by the boom of the crane.

Examples of prior art cranes having power operated outriggers of the scissors type which are shifted generally directly outwardly of the main frame are shown in the U.S. Pat. No. 4,124,226 issued Nov. 7, 1978 to Phillips or U.S. Pat. No. 3,958,813 issued May 25, 1976 to Carey, both of which have been assigned to an assignee common with the present invention.

An example of the prior art type of outriggers which are pivoted to one side of the crane for being swung about a vertical axis relative thereto are shown in the U.S. Pat. No. 3,854,595 issued Dec. 17, 1974 to Kuhn, these outriggers being of the manually swingable type; or the U.S. Pat. No. 2,914,194 issued Nov. 24, 1959 to A. W. Brown.

SUMMARY OF THE PRESENT INVENTION

The present invention provides a mobile crane having an elongated main frame with ground engaging means for supporting the frame for travel over the ground; a superstructure rotatably mounted on a frame and having an elevational boom pivoted thereto; and a pair of outriggers, one pivoted to each side of the main frame about a generally vertical axis for swinging between a transport position alongside the frame and a position extending transversely outwardly of the main frame, and power operated means carried between the inner ends of each of the outriggers and the main frame for positively swinging the outriggers. More specifically, the invention includes a hydraulically operated motor and gear reduction unit carried within the outer confines of the inner end of the outrigger and which has a gear connection with the main frame. Another aspect of the invention includes a power operated locking pin means between the main frame and the outrigger to positively lock the outrigger in any one of the positions to which it has been swung. The construction and arrangement of the power operated swinging and locking means is such that they are compact, out-of-the-way and particularly efficient in performing the functions for which they were designed.

These and other objects and advantages of the present invention will appear hereinafter as this disclosure progresses, reference being had to the accompanying drawings.

DESCRIPTION OF A PREFERRED EMBODIMENT

General Organization

Figure 1:
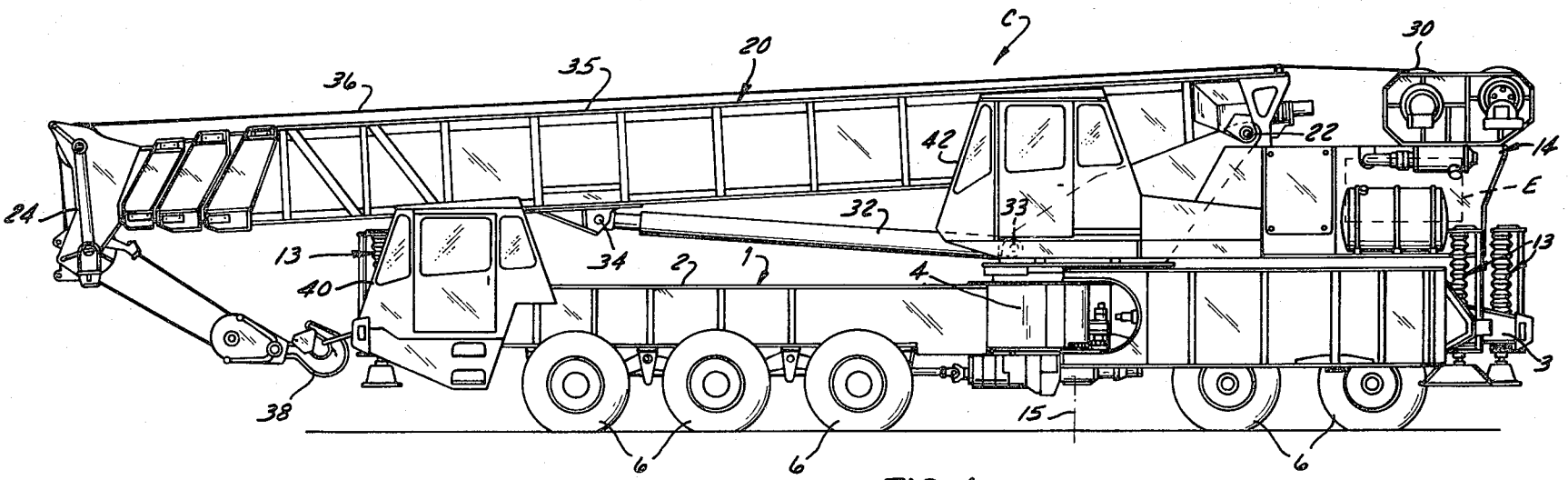
FIG. 1 is an elevational view taken from the left side of the truck crane embodying the present invention and showing the outriggers swung to the crane transport position along the main frame.
Figure 2:
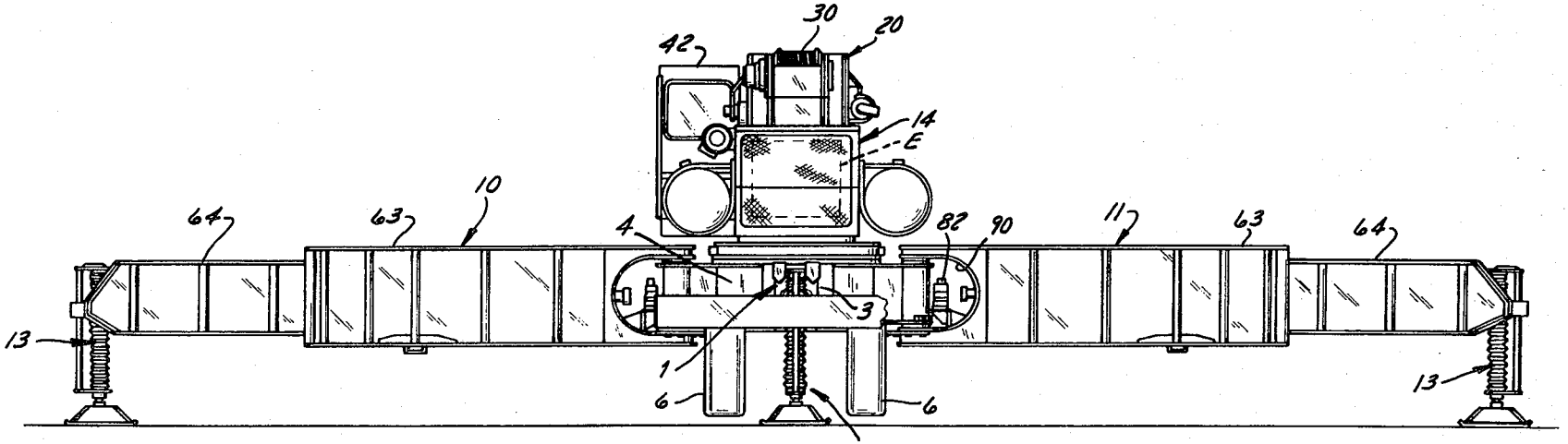
FIG. 2 is a rear view of the crane shown in FIG. 1, with the outrigger extended and swung away from the main frame to the boom operative position and with all four outrigger jacks in the ground engaging position.
Figure 3:
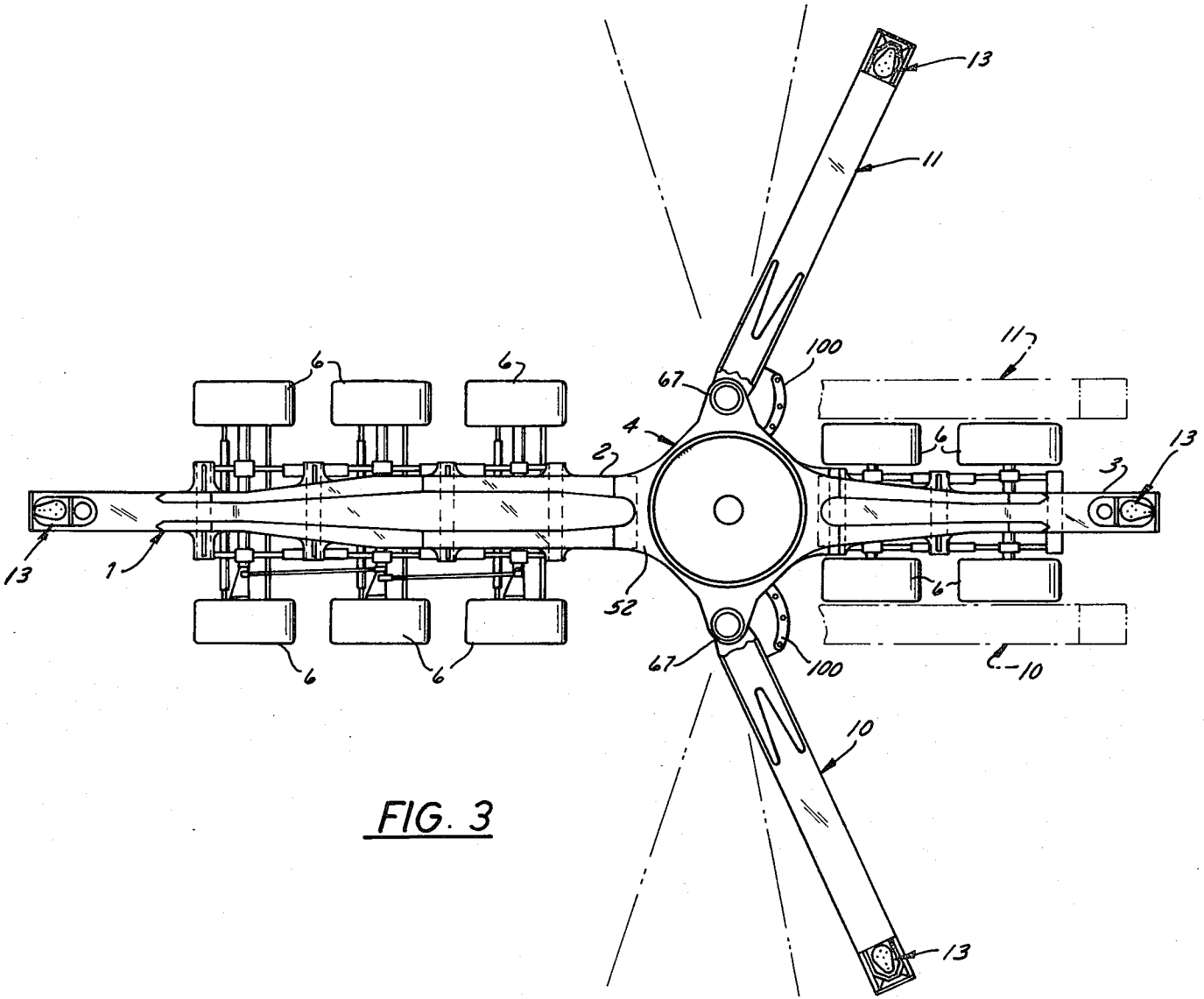
FIG. 3 is a plan view of the main frame and outriggers, showing the outriggers in the tranversely stabilizing position shown in FIG. 2, with outrigger beams retracted.

The general organization of the self-propelled truck crane C embodying the present invention shown best in FIGS. 1 and 2 include an elongated main frame 1 comprising a tubular front portion 2 and a tubular rear portion 3 which are both of rectangular transverse cross section and fabricated from steel plates that are welded together. The main frame also includes an intermediately located tub 4 to which adjacent ends of the front and rear portions are welded to form a unitary main frame. Ground engaging means 6 in the form of wheels are located and attached to the lower portion of the main frame whereby the crane can be transported from job site to job site over the highway or other terrain. A pair of transversely extendible outriggers 10 and 11 are extendible from the left and right sides of the main frame and more particularly are pivotably connected to their respective sides of the tub of the main frame as will appear in more detail. These outriggers are swingable from the transport position shown in FIG. 1 where they extend generally parallel with the main frame and alongside thereof and any one of a number of transversely extending positions outwardly of the main frame, such as shown in FIGS. 2 and 3, for stabilizing the truck crane when the boom is in operation.

A vertically extendible ground engaging jack 13 is located at each of the forward and rearward ends of the main frame and also at each of the outer ends of the two outriggers, thus providing four widely spaced apart jacks for stabilizing the crane against tipping when the boom is in the working position.

The crane also includes a superstructure 14 which is rotatably mounted about a vertical axis 15 on the upper portion of the tub 4 and is capable of rotating 360°. An extendible, telescoping boom 20 is pivotable about a horizontal shaft 22 at the upper end of the superstructure so that the boom can be vertically positioned about the horizontal axis 22. The boom is comprised of several telescoping sections so that its free end containing the boom point 24 (FIG. 1) can be extended many feet into the air. Certain essential elements of the crane are mounted on the superstructure such as the power source E which may take the form of an internal combustion engine.

The boom itself may be of conventional construction and a further description of it is deemed to be neither necessary nor desirable except to say that when fully extended on a crane with which the present invention finds particular utility, it may reach a height of several hundred feet. The boom is raised and lowered to any desired angle by the large hydraulic cylinder 32 pivoted about a horizontal axis 33 to the superstructure and also pivoted at its forward end at 34 (FIG. 1) intermediate the length of the base section 35 of the boom. A load line 36 extends from the winch 30 over conventional pulleys on the boom point and it is connected to the load hook 38 in the known manner.

An operator's cab 40 is located on the front end of the main frame and in which the operator is located for driving the crane in the transport mode. Another operator's cab 42 containing appropriate controls, is located on the superstructure and is used for operating various components of the boom and crane when the crane is in the operating mode.

Main Frame

The tub 4 is fabricated from steel and includes a cylindrical steel member 50 having its longitudinal axis disposed in a vertical direction so that the tub is circular when viewed in plan. The tub construction includes a horizontal top plate 52 and a horizontal bottom plate 53 which both extend transversely beyond each side of the tub and which are welded to the upper and lower ends of the cylindrical member 50 to form a rigid unitary construction. A steel tube 56 is welded between the plates 52 and 53 at each side of the tub to provide a pivotal mounting means for mounting the outriggers 10 and 11, one at each side of the main frame.

Steel gusset plates 57 are provided between the upper and lower plates 52, 53 and are welded thereto. The details of the construction of the main frame including the front portion 2, the rear portion 3 and the tub 4 are shown and described in the co-pending U.S. patent application Ser. No. 203,941 filed Nov. 7, 1980 and reference may be had to that application if a more complete description of the structure and advantages thereof are deemed to be either necessary or desirable.

A vertically positioned, ground engaging jack 13 is provided at both the front and rear ends of the main frame and also provided at each of the outer ends of the outriggers. These jacks can be power operated from a raised position shown in FIG. 1 for transport of the crane and a ground engaging position shown in FIG. 2 when the crane boom is to be operated. The construction and operation of these jacks is shown and described in the co-pending U.S. patent application Ser. No. 203,943 filed Nov. 7, 1980 and reference may be had to that application if a more complete description of the construction and operation of the jacks is deemed to be either necessary or desirable.

Figure 4:
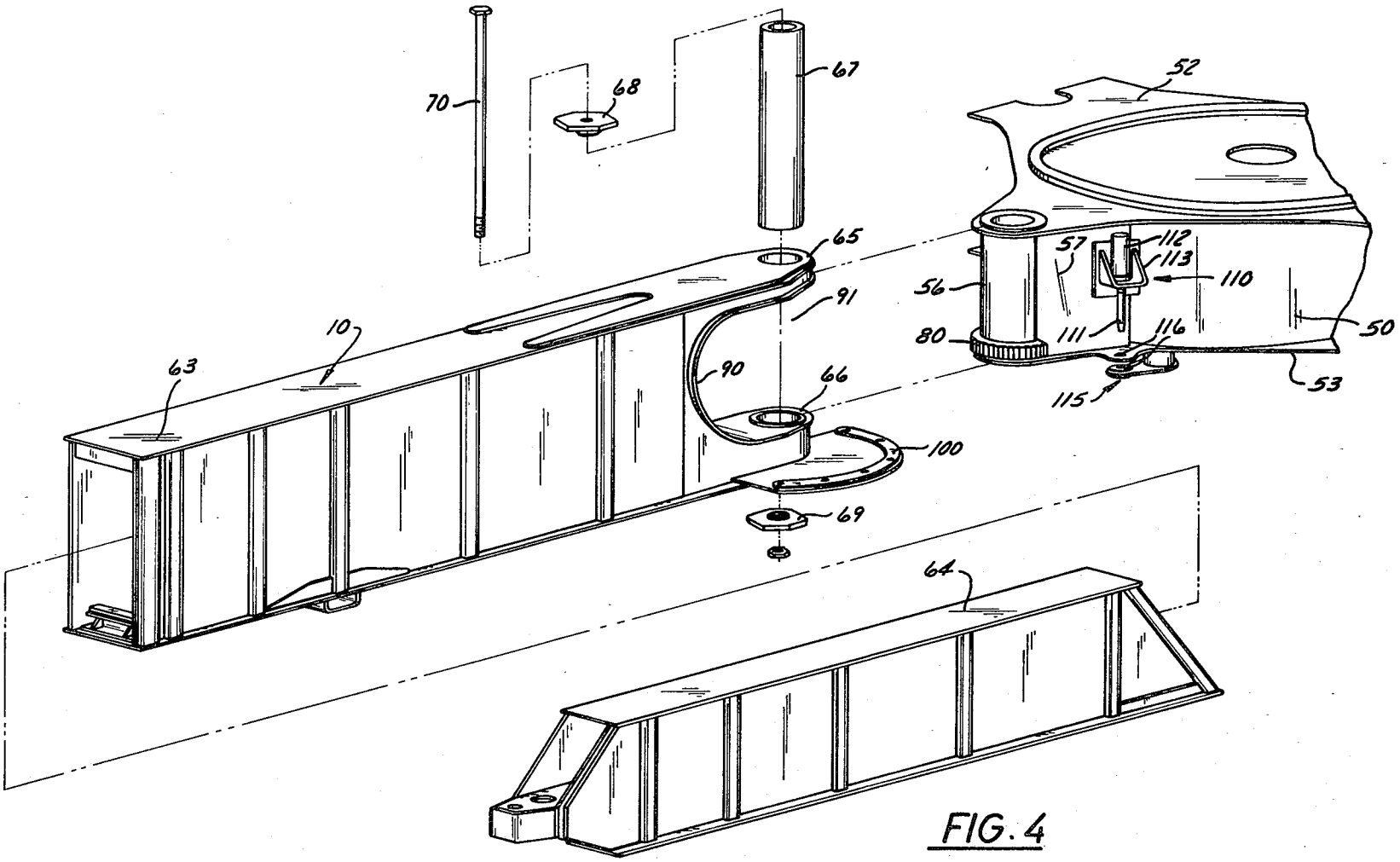
FIG. 4 is an exploded, perspective view of a portion of the central main frame tub and one of the transverse telescoping outriggers which is attachable to one side of the tub.

The outriggers 10 and 11 are identical in construction and reference will be made to only one of them. As shown in FIG. 4, the outrigger 10 includes an outer generally hollow box section 63 and an inner beam 64 telescopingly mounted within the box section. The inner end of the box section 63 is bifurcated into an upper part 65 and a lower part 66 and (FIGS. 5 and 6) a pivot tube 67 extends through aligned holes in the upper and lower parts and also through the tube 56 welded in the tub. Upper and lower caps 68 and 69 are located on the ends of the tube 67 and a bolt means 70 extends through the assembly to rigidly hold the unit in assembled relationship.

In accordance with the present invention, power operated means between the main frame and each of the outriggers is provided for swinging the outriggers to any one of a selected number of positions as follows.

Figure 7:
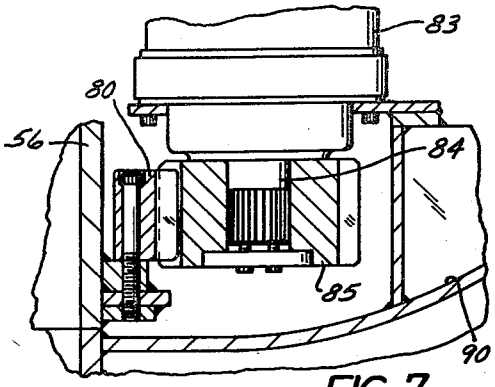
FIG. 7 is an enlarged fragmentary view of a portion of FIG. 6.
Figure 6:
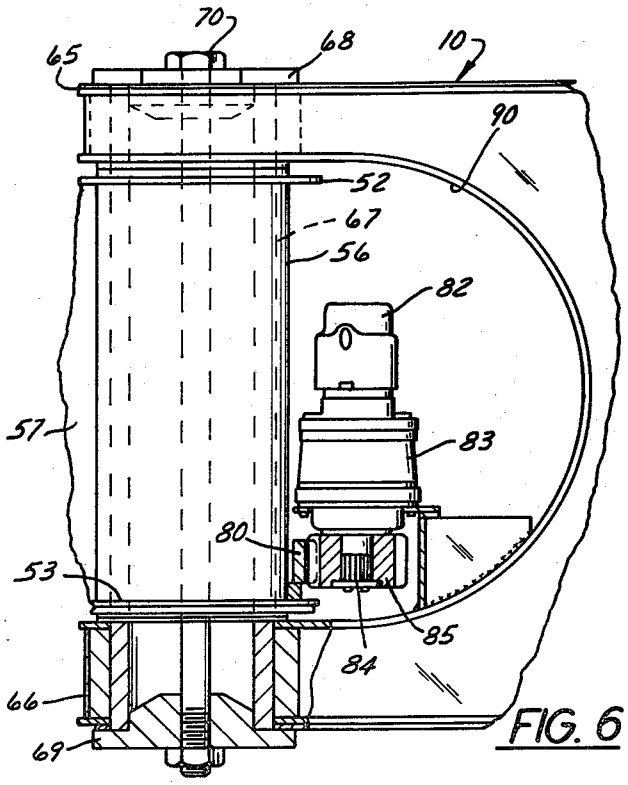
FIG. 6 is a section view taken generally along the line 6—6 in FIG. 5 and showing the hydraulic motor, speed reducer and pinion which drives against the gear segment of the main frame.
Figure 5:
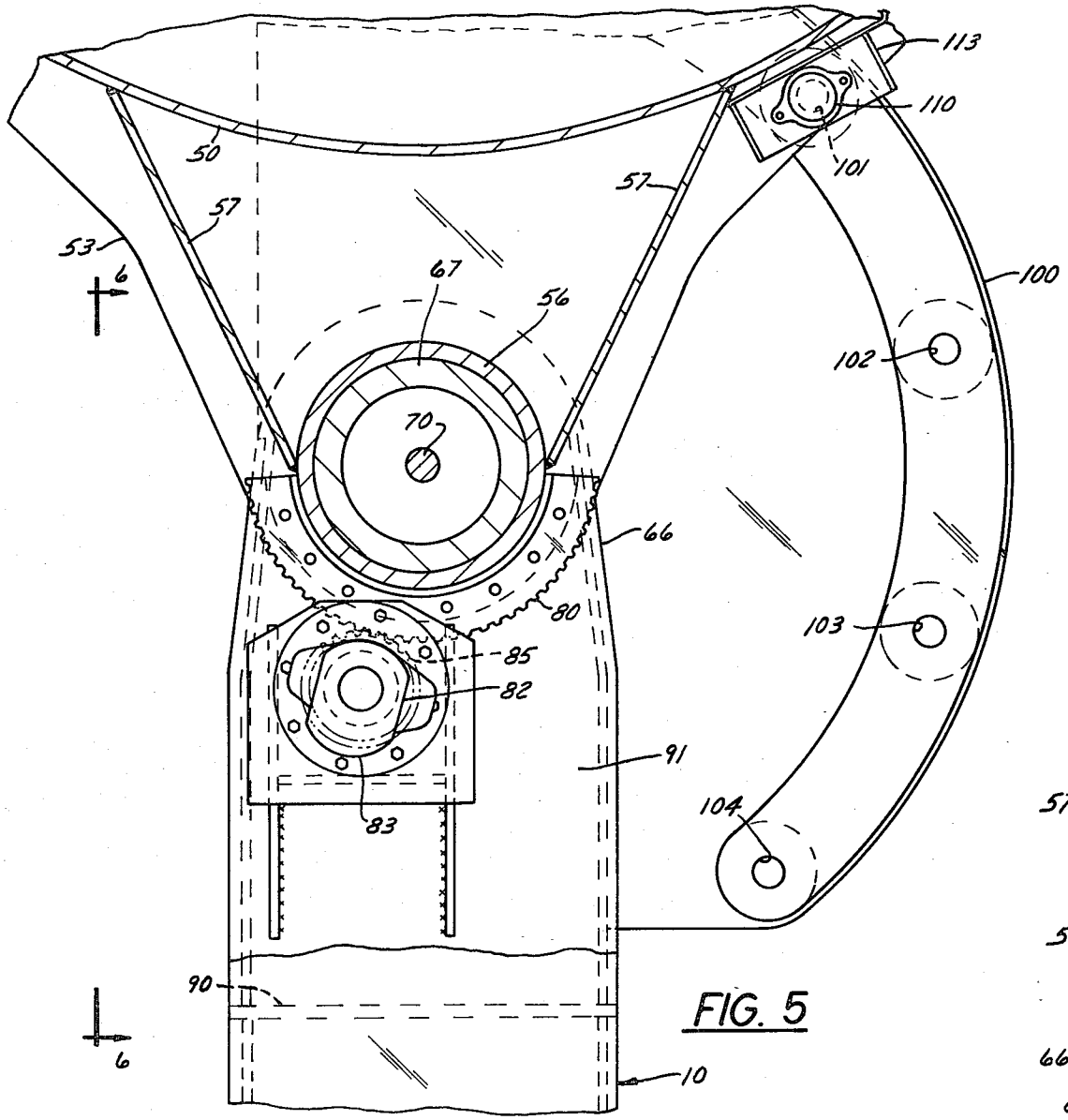
FIG. 5 is an enlarged view of the connection between the outrigger and tub as shown in FIG. 3, the view being fragmentary and showing certain parts in section or broken away for the sake of clarity in the drawings, the view furthermore showing the outrigger when it is extended transversely in the crane stabilizing position.

A gear segment 80 (FIGS. 4 and 5 for example) is bolted adjacent the lower side of each transverse side of the tub and has teeth facing outwardly therefrom. Mounting within the inner end of the outrigger, as clearly shown in FIGS. 5, 6, and 7, is a hydraulic motor 82 which drives a speed reducer 83 fixed thereto and which in turn has an output shaft 84 extending downwardly therefrom. The motor is reversible and has good low speed torque characteristics. A pinion gear 85 is splined or otherwise fixed to the shaft 84 for being driven by the hydraulic motor. Pinion 85 is in constant mesh with the larger gear segment 80. The torque developed by the pinion swings the outrigger to any desired position, and in any direction depending on the direction of rotation of the hydraulic motor.

It will be noted that the above described power swing means and gear connection is located within the outer limits of the inner end of the outriggers and are thus nested in an out-of-the-way location where they are free of obstructions commonly found on job sites, such as cables, the load swinging or being maneuvered by the crane, or others. More specifically, the inner end of the outrigger is, as previously mentioned, of bifurcated construction which is formed by the generally semi-circular plate 90 that is welded across and within the inner end of the outrigger to form a recess or pocket 91.

Figure 9:
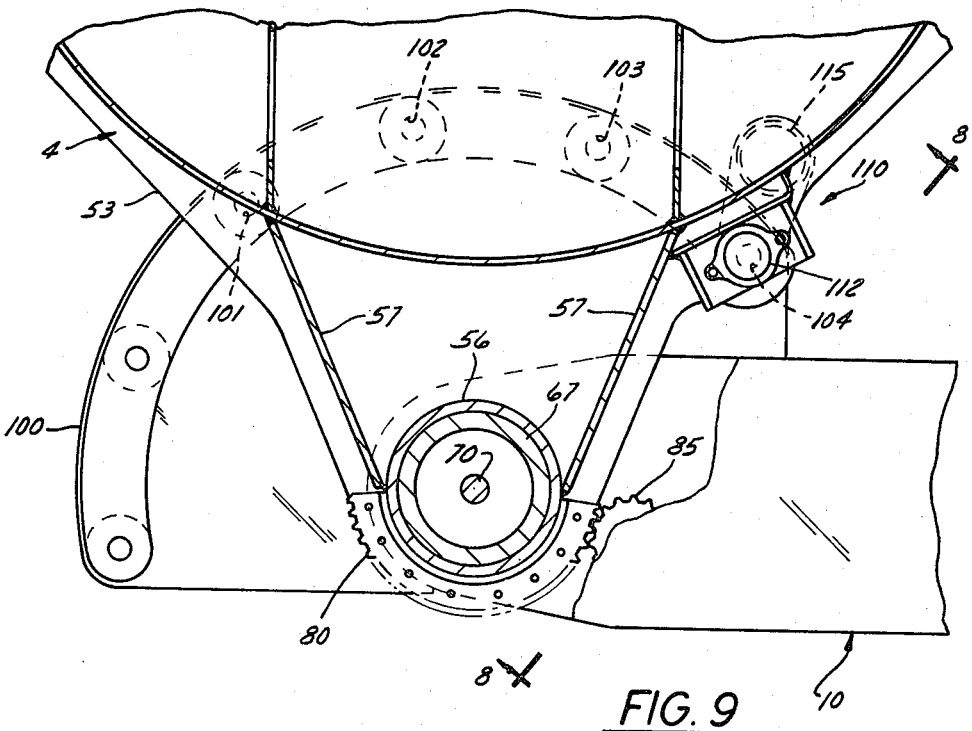
FIG. 9 is a view similar to FIG. 5, but showing the outrigger swung to the crane transport position where it is located alongside the main frame.
Figure 8:
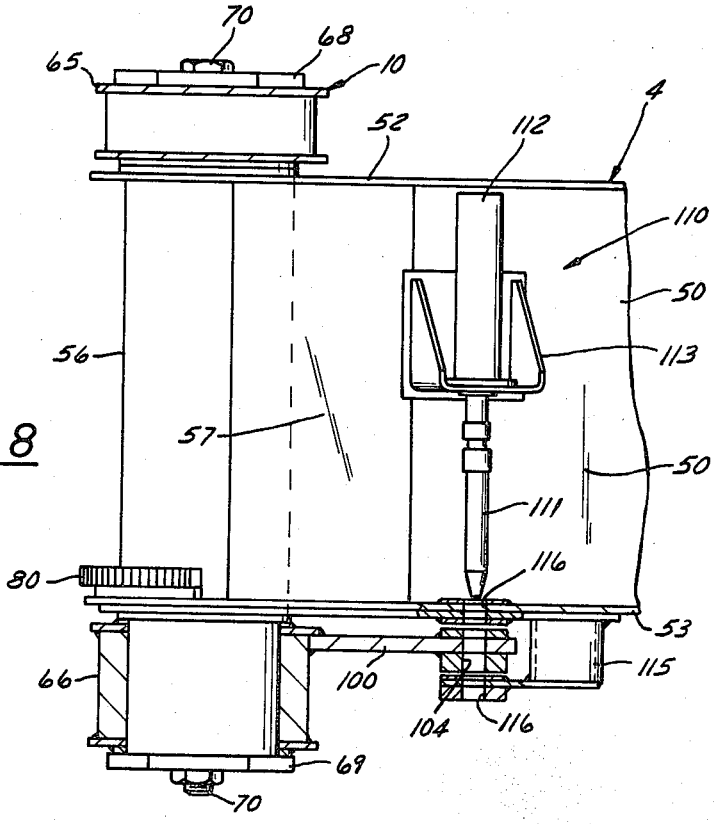
FIG. 8 is a sectional view taken generally along the line 8—8 in FIG. 9, but on a reduced scale.

Power operated means are also provided for locking the outrigger in any one of its selected positions. This means includes a semi-circular locking plate 100 which is welded to the inner end of the outrigger and extends generally from one side thereof as shown in FIGS. 4, 5, and 9. This locking plate includes a series of apertures 101, 102, 103, and 104 extending vertically therethrough and which are arranged in an arc with the pivotal center of the outrigger as the center. More specifically, the plate 100 is welded to the lower part 66 of the bifurcated end of the outrigger as clearly shown in FIGS. 4 and 8. A hydraulically actuated lock pin assembly 110 is rigidly secured to the tub of the frame, as shown in FIGS. 4, 5, 8 and 9 and has an extensible pin 111 that is actuated by the hydraulic cylinder 112 mounted in a bracket 113 to the side of the tub. A clevice means 115 is also welded at the underside of the tub and includes a pair of aligned holes 116 through which the pin 111 can be inserted. The plate 100 is swingable between the holes 116 of the clevice and thus can be aligned with the clevice holes 116 when the outrigger has been moved to its selected position. When the holes in the plate 100 and in the clevice are in vertical alignment, the pin 111 is driven through these holes thereby locking the outrigger in position. The above-described outrigger locking means is located in an out-of-the-way position so as to be free of the work area. The locking plate provides a constant moment arm to resist outrigger side loads and the entire design is compact and lightweight. The locking plate arrangement permits the operator to set the crane outriggers at various positions to lift loads to the best advantage with the space available on a particular job site.

Figure 10:
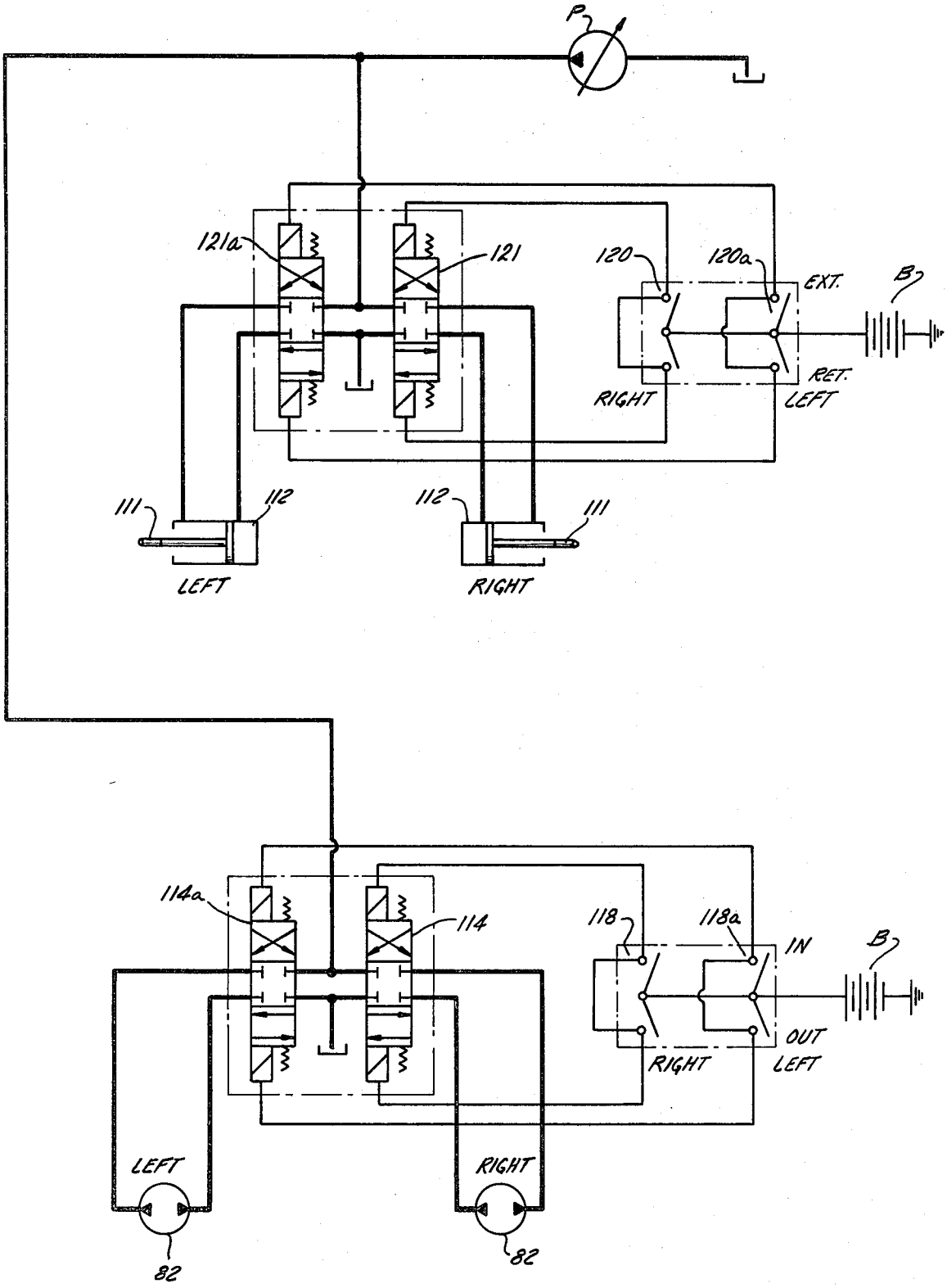
FIG. 10 is a combined hydraulic and electrical circuit of the outrigger swing and locking means.

FIG. 10 is a circuit diagram of the hydraulic and electrical components of the control system for the power swinging means and power locking means above described. Fluid pressure for the hydraulic components is supplied by a variable displacement hydraulic pump P which is driven by the engine E. The power for the electrical components is supplied from the batteries B of the crane. Both the swing motors 82 and the hydraulic cylinders 112 are controlled through electrical solenoid operated control valves 114*a*, 121 and 121*a* with pushbutton swing controls 118 and 118*a* and pushbutton lock controls 120 and 120*a*, all conveniently located on the crane.

The pushbutton controls allow the operator to selectively swing in or out, an individual outrigger or both outriggers simultaneously and to positively lock them in any desired position. This outrigger swing and lock arrangement requires no manual operation other than the electrical switches and the procedure requires minimal operational time.

We claim:

1. A mobile crane comprising, an elongated main frame, ground engaging means on said frame for supporting said frame for movement over the ground, a superstructure rotatably mounted on said frame and having an elevational boom pivoted thereto; and a pair of outriggers each having an inner end pivotally secured to said main frame at a location intermediate the length of said frame, one outrigger being secured to said frame at each side thereof and about a vertical axis for swinging between a transport position alongside said elongated main frame and a boom operative position extending transversely outwardly of said main frame, said inner end of said outriggers being of bifurcated construction formed by a generally semi-circular plane welded transversely across said inner end and defining an outwardly facing recessed pocket, power operated means mounted on said outriggers and in said pocket for swinging said outriggers relative to said main frame, said power operated means comprising a hydraulic motor and a gear reducer driven thereby, said motor and reducer being disposed in a vertical direction, and a pinion gear attached to the lower end of said reducer and driven by said reducer, and a gear segment secured to said main frame adjacent a lower side of said main frame, said segment being in mesh with said pinion gear whereby rotation of said pinion gear causes swinging of said outrigger.

2. The crane set forth in claim 1 including power operated locking means between said main frame and said outrigger for locking the outrigger in any selected position, said locking means comprising a locking plate fixed to and swingable with said outrigger, and a power operated shiftable lock pin means carried by said frame and engageable with said locking plate.

3. The crane set forth in claim 2 further characterized in that said power operated shiftable lock pin means includes a hydraulically actuated cylinder having a pin extensible therefrom and engageable with said locking plate.

* * * * *